United States Patent [19]

Thweatt, Jr.

[11] 4,144,445

[45] Mar. 13, 1979

[54] OPEN COIL ELECTRIC HEATERS

[75] Inventor: Carlisle Thweatt, Jr., Pulaski, Va.

[73] Assignee: Emerson Electric Co., St. Louis, Mo.

[21] Appl. No.: 864,621

[22] Filed: Dec. 27, 1977

[51] Int. Cl.[2] ..... H05B 3/06

[52] U.S. Cl. ..... 219/532; 219/375; 219/536; 219/545; 219/550; 219/552; 338/210; 338/317; 338/318

[58] Field of Search ..... 219/275, 375, 536, 537, 219/532, 545, 546, 550, 552, 211, 212, 345, 528, 529; 338/214, 315, 316, 317, 318, 319, 320, 208, 209, 210; 174/69, 128 R

[56] References Cited

U.S. PATENT DOCUMENTS

| | | | |
|---|---|---|---|
| 1,393,325 | 10/1921 | Smith | 338/214 |
| 1,510,125 | 9/1924 | Woodford | 338/10 |
| 1,670,075 | 5/1928 | McComsey | 219/545 |
| 1,855,092 | 4/1932 | Browne | 219/550 |
| 2,206,934 | 7/1940 | Barrans et al. | 174/69 |
| 2,321,021 | 6/1943 | Dyer, Jr. | 174/128 R |
| 2,812,409 | 11/1957 | Jones et al. | 219/545 X |
| 3,612,822 | 10/1971 | Edin | 219/275 |
| 3,816,706 | 6/1974 | Meywald | 219/537 |
| 3,835,435 | 9/1974 | Seel | 219/532 X |
| 3,860,789 | 1/1975 | Maake | 219/532 |

*Primary Examiner*—Volodymyr Y. Mayewsky
*Attorney, Agent, or Firm*—Michael Williams

[57] ABSTRACT

An open coil electric heater wherein the resistance conductor is supported on a frame. The resistance conductor in this instance, instead of being in the form of a single coiled wire, is composed of a plurality of strands of wire so as to reduce the cost of the resistance conductor while providing adequate surface area. The strands of fine wire or flat ribbon wire are braided into a rope which is formed into a series of reaches in customary manner. At least one of the strands is of a material which will provide strength to the wires that primarily generate the heat and thereby prevent sagging of such wires between wire supports. In a preferred form, the wires are loosely braided to form wide open spaces and insulated support members are projected through certain of the open spaces to support the strands in predetermined position.

11 Claims, 5 Drawing Figures

OPEN COIL ELECTRIC HEATERS

BACKGROUND AND SUMMARY

Open coil heaters, as designed in accordance with the prior art, use a standard, single resistance wire, and in such design a good part of the cost of the heater is reflected in the cost of the resistance wire. The criteria for selecting the gage of the resistance wire is related to the surface area of the wire. By choosing a larger gage wire, it is possible to reduce the operating temperature of the wire, and heretofore a size and has selected of sufficiently large gage to provide adequate life for the heater for a particular application. However, this unduly increased the cost of the heater.

I have discovered that the cost of the heater may be materially reduced by using a plurality of strands of smaller gage wire or flat ribbon wire in place of the single larger gage wire, since the weight of the resistance wire is reduced by about one-half.

However, the problem encountered in the use of fine braided wire is one of support since such wire is relatively flimsy. I have found that if at least one of the fine wires is formed of a material that will withstand the heat generated, sagging of the fine Heat-generating wires is minimized. The wires are supported in an economical manner by projecting insulated members through the open spaces of the loosely braided wires at various places along the reaches of the wires, the insulated members being secured to a frame support.

DESCRIPTION OF THE DRAWING

In the drawing accompanying this specification and forming part of this application, there is shown, for purpose of illustration, embodiments which my invention may assume, and in this drawing.

DESCRIPTION OF THE PREFERRED EMBODIMENT

Figure 1:
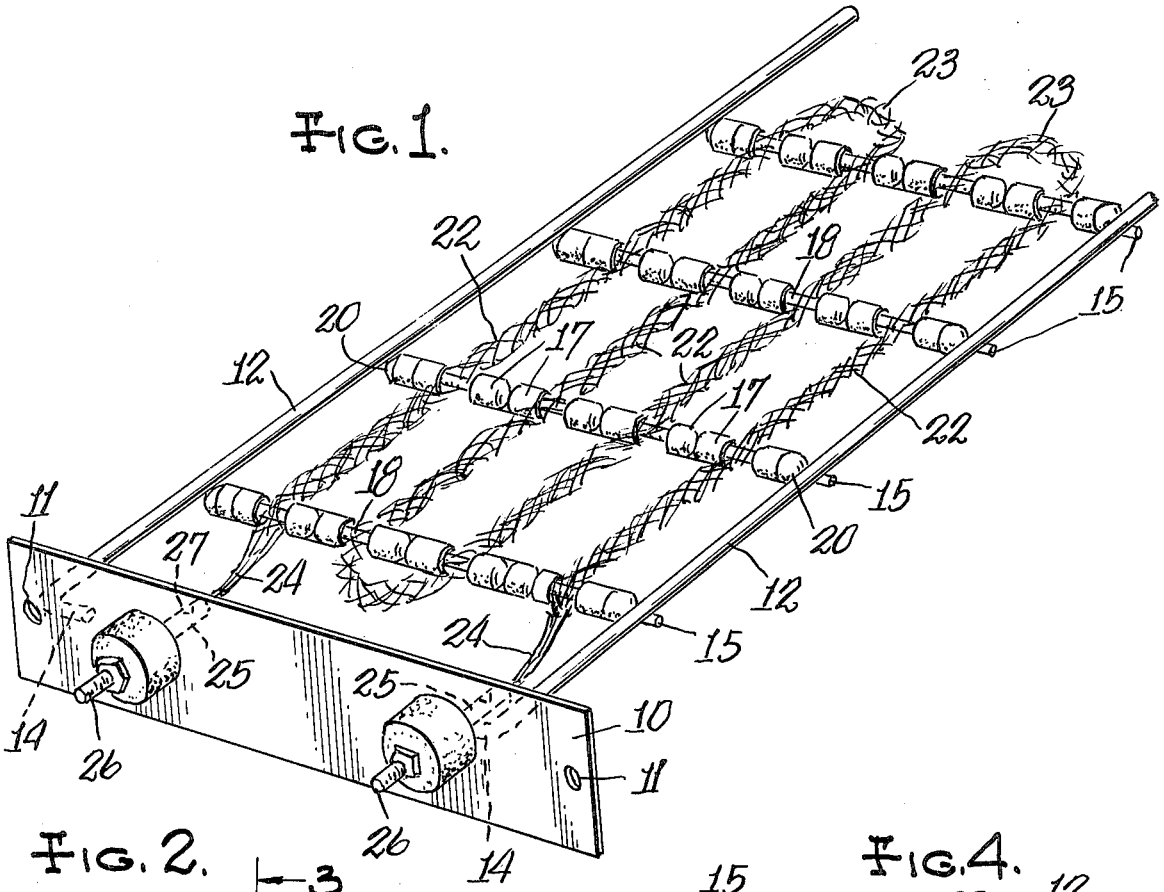
FIG. 1 is a perspective view of an open coil heater, showing an embodiment of my invention.

The open coil heater assembly illustrated in FIG. 1 is adapted to heat ambient air and quite frequently is disposed within an air duct. The heater comprises a sheet-metal plate 10 having openings 11 to pass sheet-metal screws (not shown) for mounting the heater to a support, such as the water of an air duct (not shown).

A suitable frame work is provided for supporting the resistance wire and, in the illustrated embodiment, two spaced parallel metal rods 12—12 of substantial diameter each have an angularly disposed foot 14 which is welded or otherwise secured to the rear surface of the plate 10. Metal cross-rods 15 are welded or otherwise connected across the rods 12—12 to form a rigid frame for the heating member. In some instances, the rods 15 are welded to the rods 12 after the heating resistor is mounted thereon. It will be appreciated that parts 12 and 15 need not be of rod form, but may be in the form of metal straps.

As before mentioned, the heating member of my invention comprises a plurality of strands of fine wire or ribbon, as opposed to a single heavy-gage wire or ribbon that has been used heretofore. At least one of the strands is formed of a metal which is relatively unaffected by the generated heat so as to support the other strands against sagging. In some cases, this one strand may be formed of a non-metallic material.

As an example, ten strands of fine wire or flat-ribbon wire are loosely braided into a rope. One of the strands may be of a high nickel alloy and the remaining nine strands may be of a low grade iron wire (or iron with small amounts of nickel). The nickel strand has a higher resistance so that electrical current will flow more readily through the lower resistance iron strands and therefore the iron strands will generate most of the heat and, in fact, may reach a temperature wherein they are at red heat. The high temperature nickel strand will provide strength above 1500° F. (about 815° C.) and therefore will minimize sagging of the red-hot iron wires. An economical yet efficient heating resistor is therefore produced since the iron strands will provide the required surface area for radiation of the generated heat and provide current carrying capacity at a low cost per pound of heating resistor. In some cases, the stranded heating member may include a strand (or a suitable number of strands) of glass, asbestos or ceramic fibers, and such strand or strands may be used to support the heating strands as they span the support members of a sheet metal or round bar frame.

Figure 2:
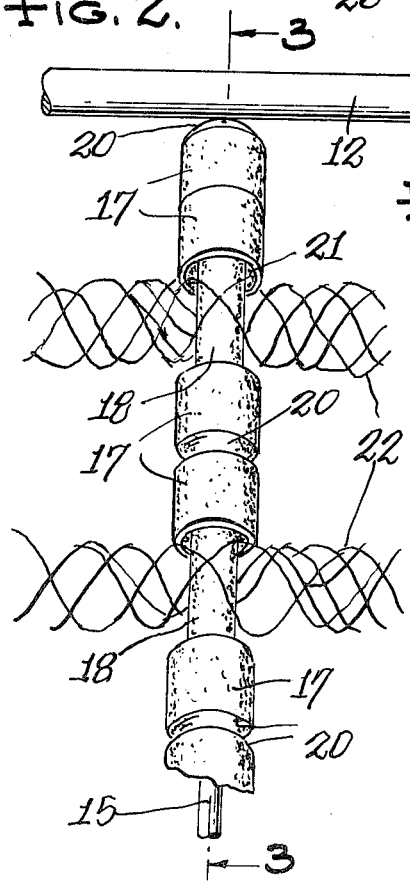
FIG. 2 is a fragmentary perspective view showing a portion of the structure of FIG. 1 drawn to an enlarged scale.
Figure 3:
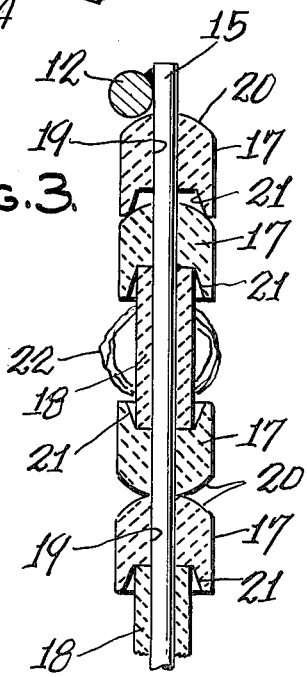
FIG. 3 is a fragmentary sectional view, corresponding generally to the line 3—3 of FIG. 2.

As best seen in FIG. 2, the strands forming the heating member are very loosely interwoven so as to provide large open spaces between the strands, so that an insulated support may be projected therethrough. As seen in FIGS. 2 and 3, a plurality of ceramic beads 17 and ceramic sleeves 18 are assembled on a cross-rod 15 before the latter is welded to the support rods 12—12 to provide adquate insulation for the heating member. The beads 17 are preferably of similar formation and each has an opening 19 to closely pass a rod 15 and a rounded nose 20 at one end and a socket 21 at the opposite end. At one end of the rod 15, two beads are arranged in a butting relation, as seen in FIG. 3, with the nose 20 of the innermost one within the socket 21 of the other, the nose of the latter, on assembly of the rod 15 with the support rod 12, engaging the latter to minimize movement along the cross-rod 15. A ceramic sleeve 18 is threaded onto the rod 15 with opposite ends fitting within the sockets 21 of adjoining beads. In this manner, a long creepage path is provided to insure against shorting of the heating member on the cross-rod 15. The beads on opposite ends of a sleeve form abutments which restrict movement of the captured part of the heating member in a direction axially of a rod 15.

The braided rope, as seen in FIG. 1, is shaped to provide a plurality of reaches 22 which are integrally connected by loops 23 at one end and have terminal portions 24 at the opposite ends. The strands forming the terminal portions 24 may be disposed within a tubular portion 25 of a respective terminal post 26, the tubular portion then being crimped as at 27 to mechanically and electrically secure the terminal portions to respective posts.

DESCRIPTION OF THE OTHER EMBODIMENT

Figure 4:
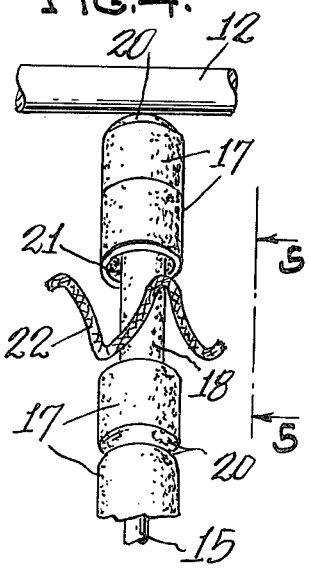
FIG. 4 is a fragmentary perspective view somewhat like FIG. 2, but showing another embodiment of my invention.
Figure 5:
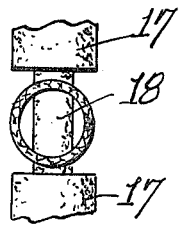
FIG. 5 is a fragmentary view corresponding to the line 5—5 of FIG. 4.

The heating member may take the form shown in FIG. 4, which form possesses the same advantages of that heretofore described. The plurality of strands of the embodiment of FIG. 4 are twisted or woven tighter than the embodiment of FIGS. 1 through 3 to form the heating rope, and this rope is then wound to a longitudinally spiralled formation with the pitch of the spiral being such that parts of adjoining convolutions will snuggly fit over and around a sleeve 18, as shown in FIG. 4, to hold the heating member to the supporting frame.

I claim:

1. An electric heating assembly of the open coil type, comprising:

a pair of rigid, laterally spaced support members, a plurality of rigid, spaced cross-members disposed crosswise of said support members and secured thereto to form a generally plane supporting frame, and an elongated heating member supported by and insulated from said frame and including reflexed portions providing spaced reaches extending crosswise of said cross-members and disposed generally within the plane of said frame, said heating member comprising a plurality of strands combined side-by-side, that portion of each reach adjoining a cross-member being constructed and arranged to have holding interengagement with the cross-member to thereby hold said reaches to said cross-member.

2. The construction according to claim 1 wherein certain of said strands have physical properties different than that of others.

3. The construction according to claim 1 wherein all strands are formed of electric conductors having current resistant properties.

4. The construction according to claim 1 wherein the majority of said strands are of a low grade iron wire and at least one is of a high nickel alloy wire.

5. The construction according to claim 1 wherein at least one of said strands is of a non-conducting material.

6. The construction according to claim 1 wherein said strands are interwoven.

7. The construction according to claim 6 wherein said interwoven strands form a rope-like heating member which is thereafter longitudinally spiralled, adjoining convolutions of the spiralled heating member engaging spaced surfaces of a cross-member in holding relation.

8. An electric heating assembly of the open coil type, comprising:

a pair of rigid, laterally spaced support members, a plurality of rigid, spaced cross-members disposed crosswise of said support members and secured thereto to form a supporting frame, and an elongated heating member supported by and insulated from said frame and including reflexed portions providing spaced reaches extending crosswise of said cross-members, said heating member comprising a plurality of strands which are loosely interwoven to provide spaces between at least certain strands, said cross-members providing through certain of said spaces to hold said heating member to said frame.

9. The construction according to claim 8 wherein insulation members are carried by said cross-members at the places where said reaches cross said cross-members, each insulating member projecting through a said space to hold said heating member to and insulated from said frame.

10. The construction according to claim 8 wherein said cross-members are metal rods having insulating sleeves thereon, said insulating sleeves projecting through said strand spaces to hold said heating member to and insulated from said frame.

11. The construction according to claim 10 wherein a plurality of insulating beads are disposed on said rods, said beads being of larger diameter than said sleeves with beads on opposite ends of a sleeve to form abutments to restrict movement of a reach axially of a said rod.

* * * * *

UNITED STATES PATENT OFFICE

CERTIFICATE OF CORRECTION

PATENT NO. : 4,144,445

DATED : March 13, 1979

INVENTOR(S) : Carlisle Thweatt, Jr.

It is certified that error appears in the above-identified patent and that said Letters Patent are hereby corrected as shown below:

In the Background and Summary, Line 12, cancel the second occurance of "and" and insert "been" before ---selected---, so the line will read ---of the wire, and heretofore a size has been selected of---.

Also in the Background and Summary, line 25, "Heat-generating" should be ---heat generating---.

Claim 8, line 13 thereof, "providing" should be ---projecting---.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*